US010639915B2

(12) United States Patent
Wakita

(10) Patent No.: US 10,639,915 B2
(45) Date of Patent: May 5, 2020

(54) PRINTING APPARATUS

(71) Applicant: SEIKO EPSON CORPORATION, Tokyo (JP)

(72) Inventor: Masaaki Wakita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/761,399

(22) PCT Filed: Sep. 27, 2016

(86) PCT No.: PCT/JP2016/004352
§ 371 (c)(1),
(2) Date: Mar. 19, 2018

(87) PCT Pub. No.: WO2017/056482
PCT Pub. Date: Apr. 6, 2017

(65) Prior Publication Data

US 2018/0272766 A1 Sep. 27, 2018

(30) Foreign Application Priority Data

Oct. 2, 2015 (JP) ..... 2015-196536

(51) Int. Cl.
*B41J 15/04* (2006.01)
*B65H 23/04* (2006.01)
*B41J 11/00* (2006.01)

(52) U.S. Cl.
CPC ..... *B41J 15/046* (2013.01); *B41J 11/001* (2013.01); *B41J 11/002* (2013.01);
(Continued)

(58) Field of Classification Search
CPC ..... B41J 11/002; B41J 11/005; B41J 11/04; B41J 11/58; B41J 13/20
See application file for complete search history.

(56) References Cited

U.S. PATENT DOCUMENTS 415,535 A * 11/1889 Lasar ..... B41J 11/005 400/642
2,808,919 A * 10/1957 Frobel ..... B41J 11/70 400/565

(Continued)

FOREIGN PATENT DOCUMENTS

CN 103802501 A 5/2014
EP 2384893 A 11/2011

(Continued)

OTHER PUBLICATIONS

International Search Report dated Dec. 20, 2016 for PCT/JP2016/004352.

*Primary Examiner* — John Zimmermann
(74) *Attorney, Agent, or Firm* — Workman Nydegger

(57) ABSTRACT

A printing apparatus including a transport guiding portion with high manufacturing yield, is provided. A printing apparatus includes a printing portion which is able to print on a medium, a transport portion which transports the medium, and a transport guiding portion on which a transport surface on which the medium is transported is formed and which has a plurality of bent portions, in which the transport guiding portion is provided with a first guiding member which has a bent portion and forms the transport surface on a transport direction upstream side of the medium and a second guiding member which has a bent portion and forms the transport surface on a transport direction downstream side of the medium.

5 Claims, 5 Drawing Sheets

(52) U.S. Cl.
CPC ... *B65H 23/048* (2013.01); *B65H 2301/5143* (2013.01); *B65H 2402/11* (2013.01); *B65H 2404/62* (2013.01); *B65H 2801/36* (2013.01)

(56) References Cited

U.S. PATENT DOCUMENTS

| | | | | |
|---|---|---|---|---|
| 4,799,814 | A | 1/1989 | Okubo et al. | |
| 4,934,850 | A | 6/1990 | Okubo et al. | |
| 6,196,672 | B1 | 3/2001 | Ito | |
| 2010/0157006 | A1 | 6/2010 | Kanada et al. | |
| 2012/0162334 | A1 | 6/2012 | Sasaki | |
| 2014/0132689 | A1 | 5/2014 | Ishikawa et al. | |
| 2016/0054686 | A1* | 2/2016 | Yamagishi | G03G 15/2028 399/401 |
| 2017/0320341 | A1* | 11/2017 | Wander | B41J 11/001 |

FOREIGN PATENT DOCUMENTS

| | | | |
|---|---|---|---|
| EP | 2657168 | A | 10/2013 |
| JP | 61-209181 | A | 9/1986 |
| JP | 06-032486 | A | 2/1994 |
| JP | 09-124182 | A | 5/1997 |
| JP | 2003-182168 | A | 7/2003 |
| JP | 2009-279877 | A | 12/2009 |
| JP | 2010-149319 | A | 7/2010 |
| JP | 2012-139822 | A | 7/2012 |
| JP | 2013-028094 | A | 2/2013 |
| JP | 2014-104604 | A | 6/2014 |

* cited by examiner

[Fig. 1]
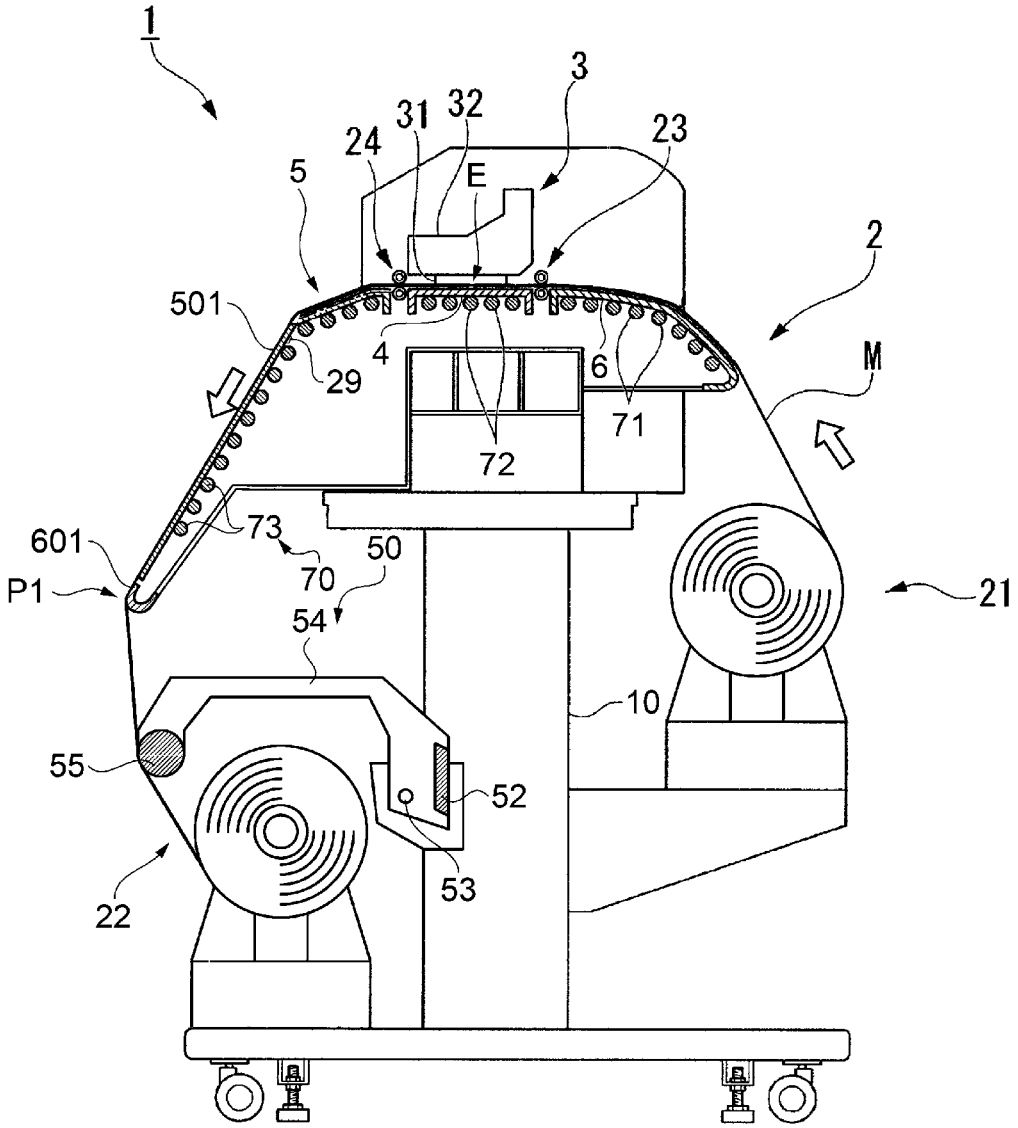

[Fig. 2]
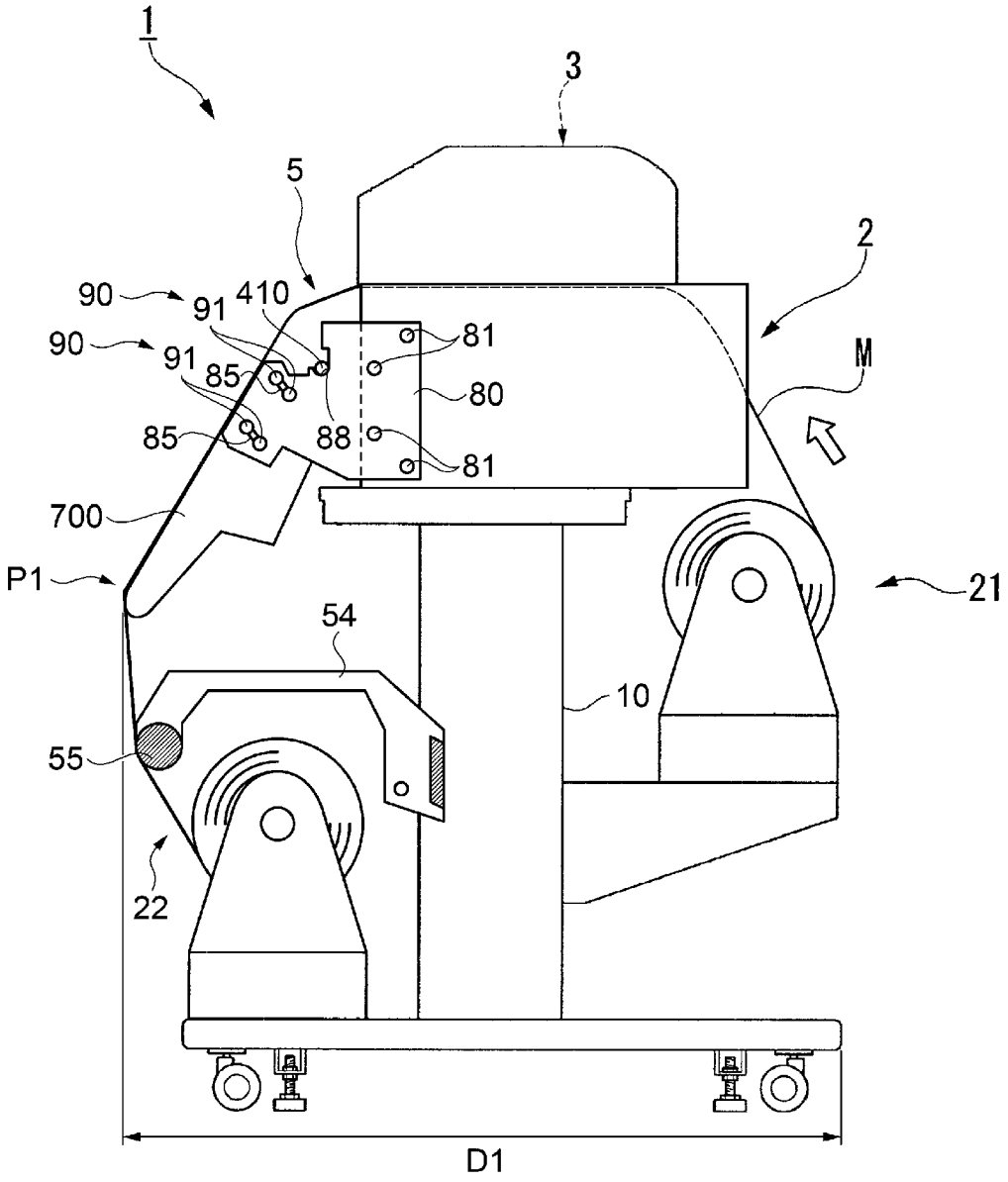

[Fig. 3]
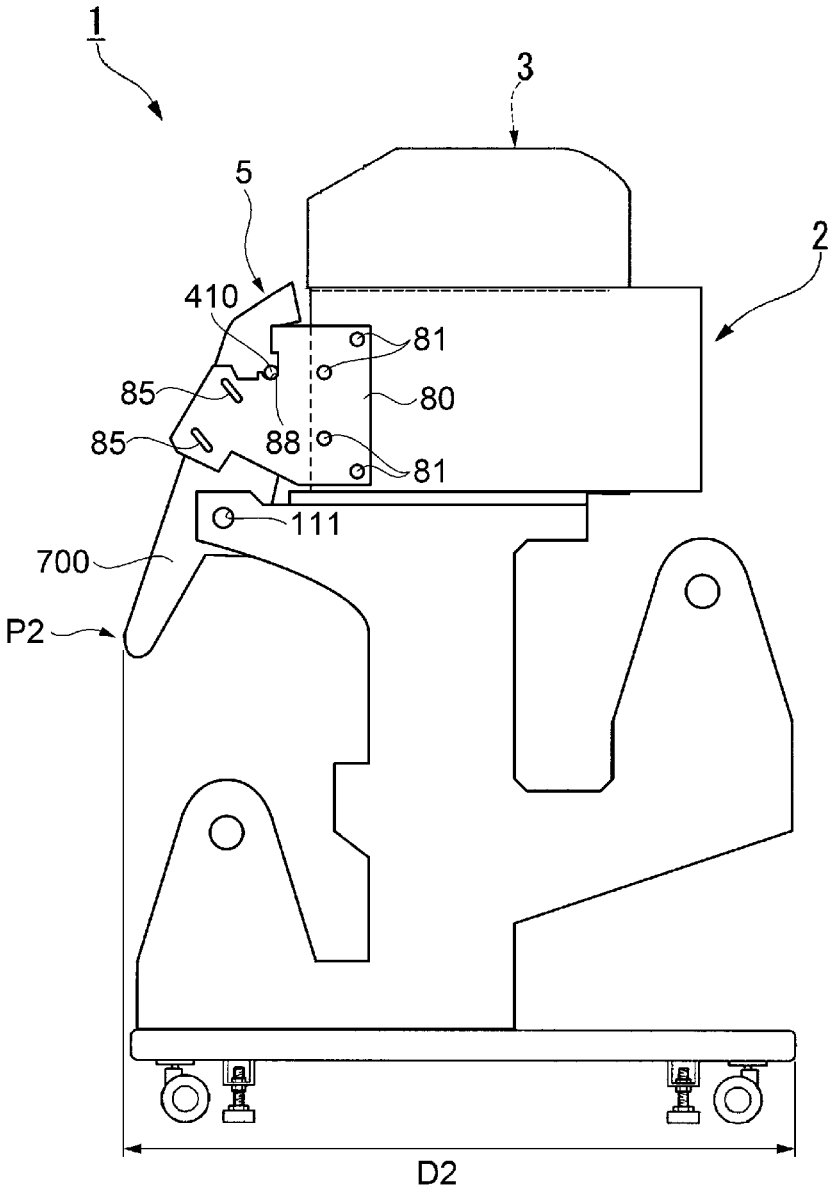

[Fig. 4]
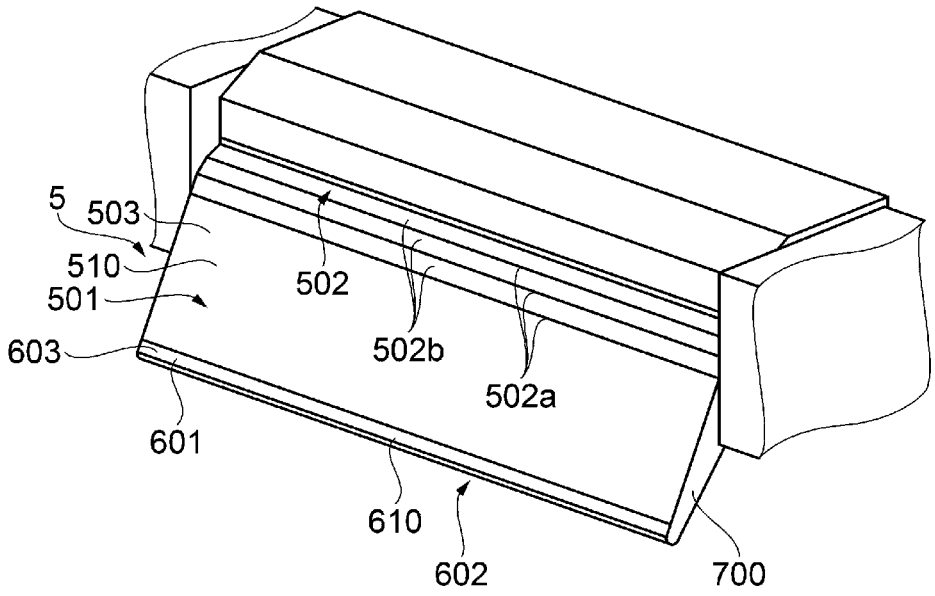

[Fig. 5]
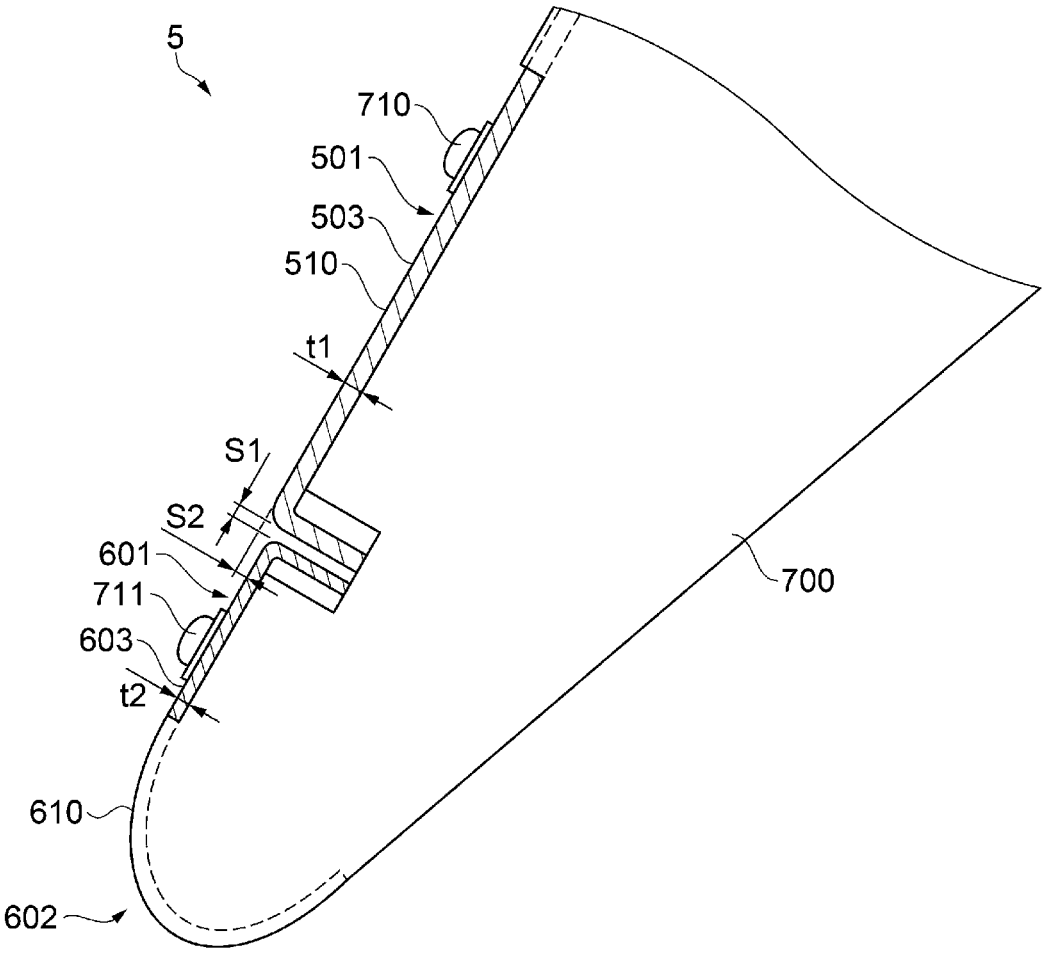

PRINTING APPARATUS

TECHNICAL FIELD

The present invention relates to a printing apparatus.

BACKGROUND ART

In the related art, an ink jet printer is known which includes an ink jet head, transport means which transports a recording medium, and a transport path along which the recording medium is transported. The transport path of the ink jet printer includes a front guiding plate that is configured from a single plate made of aluminum (for example, refer to PTL 1).

CITATION LIST

Patent Literature

PTL 1: JP-A-2009-279877

SUMMARY OF INVENTION

Technical Problem

However, the ink jet printer is assumed to be a large type printer which is able to print on large format media, and the size of the front guiding plate is large. However, since the front guiding plate has a curved portion (bent portion) and the like, there is a problem in that it is difficult to form the front guiding plate which includes the curved portion from a single plate and manufacturing yield of the front guiding plate is lowered.

Solution to Problem

The present invention is carried out in order to solve at least a part of the problem described above and can be realized in the following aspects or application examples.

Application Example 1

A printing apparatus according to the present application example includes a printing portion which is able to print on a medium, a transport portion which transports the medium, and a transport guiding portion on which a transport surface on which the medium is transported is formed and which has a plurality of bent portions, in which the transport guiding portion is provided with a first guiding member which has a bent portion and forms the transport surface on a transport direction upstream side of the medium and a second guiding member which has a bent portion and forms the transport surface on a transport direction downstream side of the medium.

According to this configuration, the transport guiding portion is configured by the first guiding member and the second guiding member. That is, the transport guiding portions are not formed in one member and are separately formed. Accordingly, in comparison to a case where the transport guiding portion which has a bent portion that is relatively difficult to process is formed in one member, since it is easier to form the transport guiding portion with a plurality of members, it is possible to increase manufacturing (processing) yield of the transport guiding portion.

Application Example 2

In the printing apparatus according to the application example described above, the first guiding member and the second guiding member are separated.

According to this configuration, it is possible to prevent interference of the members with each other by separating the first guiding member and the second guiding member.

Application Example 3

The second guiding member of the printing apparatus according to the application example described above has a lower height of a normal direction of the transport surface than the first guiding member.

According to this configuration, it is possible to smoothly transport the medium which is transported from the first guiding member side without the second guiding member being a hindrance.

Application Example 4

The first guiding member of the printing apparatus according to the application example described above is a heat generating portion.

According to this configuration, it is possible to transport the medium on which liquid is applied in the first guiding member while heating.

Application Example 5

The first guiding member of the printing apparatus according to the application example described above is thicker than the second guiding member.

According to this configuration, it is possible to secure rigidity in the first guiding member.

Application Example 6

In the printing apparatus according to the application example described above, the first guiding member and the second guiding member are supported by a common member at an end portion in a direction which intersects with the transport direction.

According to this configuration, it is possible to stably form a transport path for a medium by supporting using the common member.

BRIEF DESCRIPTION OF DRAWINGS

FIG. 1 is a side sectional view illustrating a configuration of a printing apparatus.

FIG. 2 is a side view illustrating a configuration of the printing apparatus.

FIG. 3 is a side view illustrating a configuration of the printing apparatus.

FIG. 4 is a perspective view illustrating a partial configuration of the printing apparatus.

FIG. 5 is a side view illustrating a partial configuration of the printing apparatus.

DESCRIPTION OF EMBODIMENT

An embodiment of the invention will be described below with reference to the drawings. Note that, in each of the drawings described below, the scale of each member and the like is indicated differently from the actual size in order for the sizes of each member and the like to be to the extent so as to be recognizable in the drawings.

First, the configuration of a printing apparatus will be described. For example, the printing apparatus is an ink jet printer. In the present embodiment, a large format printer (LFP) which handles relatively large type media is described as a configuration example of the printing apparatus.

FIG. 1 is a side sectional view illustrating a configuration of the printing apparatus, and FIGS. 2 and 3 are side views illustrating configurations of the printing apparatus. In addition, FIG. 4 is a perspective view illustrating a partial configuration of the printing apparatus, and FIG. 5 is a side view illustrating a partial configuration of the printing apparatus.

As shown in FIG. 1, a printing apparatus 1 is provided with a transport portion 2 which transports a medium M using a roll-to-roll method, a printing portion 3 which records an image, a character, or the like by discharging (ejecting) ink as an example of liquid on the medium M, a transport guiding portion 5 which transports the medium M, and platen 4 which is disposed at a position facing the printing portion 3. In addition, as shown in FIG. 2, the printing apparatus 1 is provided with a support portion 80 which supports the transport guiding portion 5. In addition, the printing apparatus 1 has a printing portion (not shown in the drawings) and the like which controls the transport portion 2, the printing portion 3, or the like. In addition, the printing apparatus 1 is provided with a tension adjustment portion 50 that is able to apply tension to the medium M by contacting the medium M. Then, each configuring portion is supported on a body frame 10.

The transport portion 2 has a roller 21 which delivers the roller shaped medium M in a transport direction (arrow direction in the Figs.) and a roller (reel unit) 22 which is able to wind the delivered medium M. In addition, the transport portion 2 has a transport roller pair 23 and 24 which transport the medium M on the transport path between the rollers 21 and 22.

The printing portion 3 is able to discharge ink in a discharge region E, and has a recording head (ink jet head) 31 that is able to discharge ink on the medium M, and a carriage 32 which is reciprocally movable in the width direction of the medium M by placing the recording head 31. The recording head 31 is provided with a plurality of nozzles, and is configured to be able to discharge ink for which penetration drying or evaporative drying is necessary by selecting a relationship with the medium M. Then, it is possible to record the image, the character, or the like on the medium M by discharging ink from the recording head 31 while reciprocally moving the carriage 32. Note that, the printing portion 3 may be configured to be able to discharge liquid across the width direction of the medium M without moving. At this time, the printing portion 3 has a configuration in which a nozzle row is formed along the width direction of the medium M and is referred to as a so-called line head.

The platen 4 is disposed to be able to support the medium M in the discharge region E in which ink is discharged by the printing portion 3. That is, the printing apparatus 1 is provided with the platen 4 which is able to support the medium M onto which liquid is discharged in the discharge region E. In the embodiment, the platen 4 is disposed between the transport roller pair 23 and the transport roller pair 24.

The transport guiding portion 5 is disposed to be able to support the medium M further on the downstream side in the transport direction of the medium M than the platen 4. In the embodiment, as shown in FIG. 1, the transport guiding portion 5 is provided between the transport roller pair 24 and the roller 22 on the transport path of the medium M.

In addition, the printing apparatus 1 of the embodiment is configured to be displaceable in a state in which the transport guiding portion 5 is developed and a state in which the transport guiding portion 5 is folded to the body frame 10 side. First, a configuration of the state in which the transport guiding portion 5 is developed will be described. As shown in FIG. 2, the pair of support portions 80 are provided which are fixed by a fixing member 81 on the apparatus main body side. Then, the transport guiding portion 5 and the support portion 80 are fastened by a fastening member 90. The fastening member 90 is configured by a bolt hole and a bolt 91. In detail, two guide holes 85 of the pair of support portions 80 are respectively provided in the pair of support portions 80, and the bolt hole is provided positioned on the transport guiding portion 5 corresponding to both end portions of each guide hole 85. Then, the bolt 91 is fitted in the guide hole which is provided at the position corresponding to both end portions of each guide hole 85 via the guide hole 85 of the support portion 80. Thereby, the transport guiding portion 5 and the support portion 80 are fastened, and is held in a state in which the transport guiding portion 5 is developed.

Next, a configuration of a state in which the transport guiding portion 5 is folded to the body frame 10 side will be described. First, the bolt 91 of the fastening member 90 is removed. Here, a shaft portion 410 which extends in a direction which intersects with the transport direction of the medium M is provided on the transport guiding portion 5. Then, as shown in FIG. 3, the shaft portion 410 is received at a reception groove 88 of the support portion 80 due to self weight of the transport guiding portion 5, and the end portion on the downstream side in the transport direction of the medium M of the transport guiding portion 5 is rotatably moved to the apparatus main body side centered on the shaft portion 410. That is, the transport guiding portion 5 is in a state of being folded to the body frame 10 side.

In addition, in this state, as shown in FIGS. 2 and 3, a length D2 of the apparatus main body in a state in which the transport guiding portion 5 is folded is shorter than a length D1 of the apparatus main body in a state in which the transport guiding portion 5 is developed with respect to a length in a depth direction of the apparatus main body of the printing apparatus 1. Here, in a case where the printing apparatus 1 is viewed from the side surface direction, the depth direction of the apparatus main body refers to a direction which is horizontal to a ground surface (installation surface of the printing apparatus 1). In the embodiment, the depth direction refers to a direction which is orthogonal to the movement (scanning) direction of the carriage 32 of the printing portion 3. Note that, according to necessity, the rollers 21 and 22 and the tension adjustment portion 50 may be removed from the apparatus main body. Thereby, it is possible to shorten length in the depth direction of the apparatus main body, it is possible to reduce weight, and it is possible to effectively perform transport work of the printing apparatus 1.

Note that, in a case where the printing apparatus 1 is displaced from a state in which the transport guiding portion 5 is folded to the body frame 10 side to a state where the transport guiding portion 5 is developed, a tip end portion of the transport guiding portion 5 is moved in a direction (development direction) separated from the apparatus main body centered on the shaft portion 410. Then, the bolt 91 is fitted corresponding to the guide hole 85 of the support portion 80. Thereby, the transport guiding portion 5 is in a state of being developed.

The tension adjustment portion 50 is able to apply tension to the medium M. The tension adjustment portion 50 of the embodiment is disposed to be able to apply tension to the medium M between the transport guiding portion 5 and the roller 22. The tension adjustment portion 50 is provided with a pair of frame portions 54, and is configured to be rotatable centered on the rotary shaft 53. In addition, a tension bar 55 is disposed between one ends of the pair of frame portions 54. The tension bar 55 is formed to be longer in the width direction than a width of the medium M. Then, there is a configuration in which tension is applied to the medium M by one portion of the tension bar 55 contacting the medium M. Meanwhile, a weight portion 52 is disposed between other ends of the pair of frame portions 54. Thereby, it is possible to displace a position of the tension adjustment portion 50 by rotating the tension adjustment portion 50 centered on the rotary shaft 53.

Next, a detailed configuration of the transport guiding portion will be described. In the transport guiding portion 5, the transport surface is formed on which the medium M is transported, and the transport guiding portion which has a plurality of bent portions is provided. In detail, as shown in FIGS. 4 and 5, the transport guiding portion 5 is provided with a first guiding member 501 and a second guiding member 601. That is, the transport guiding portion 5 is configured by a plurality of members (two members in the embodiment). The first guiding member 501 and the second guiding member 601 are made of metal, and for example, are formed by processing aluminum or an alloy plate material with aluminum as a main component.

The first guiding member 501 has a first bent portion 502, and has a first transport surface 510 on the transport direction upstream side of the medium M. Then, on a first transport surface 510 of the first guiding member 501, a first bent portion 502 is disposed on the transport direction upstream side of the medium M, and a first flat portion 503 is disposed on the transport direction downstream side of the medium M of the first bent portion 502.

The first bent portion 502 has a shape in which a portion of the first transport surface 510 is bent into a plurality of folds in the transport direction of the medium M. For example, the first bent portion 502 forms a plurality of folds 502*a* in a direction which intersects substantially perpendicular to the transport direction of the medium M and is an aggregation of a plurality of flat surface portions 502*b* that are formed between adjacent folds 502*a* with respect to a flat plate portion which is a raw material of the first guiding member 501 using a press die. The first bent portion 502 is able to smoothly transport the medium M on which the ink is applied by the printing portion 3 to the transport downstream side via the first bent portion 502 since the first bent portion 502 is disposed further on the transport direction downstream side of the medium M than the transport roller pair 24. In addition, the first flat portion 503 has a flat surface, and transports the medium M which is transported from the first bent portion 502 side to the second guiding member 601 side.

In addition, as shown in FIG. 1, the first guiding member 501 has a heat generating portion 70. The heat generating portion 70 is configured by a heater 73. Thereby, the first guiding member 501 is heated, and it is possible to heat the medium M which is transported on the first guiding member 501. The heater 73 of the embodiment is disposed on the surface (rear surface) side on the opposite side from a surface which supports the medium M in the transport guiding portion 5. For example, the heater 73 is a tube heater, and is affixed to the rear surface of the transport guiding portion 5 via an aluminum tape or the like. Then, the transport surface which supports the medium M is heated in the transport guiding portion 5 due to heat conduction by driving the heater 73, and it is possible to heat the medium M from the rear side of the medium M. Note that, also in the same manner in the platen 4, the heater 72 is disposed on a surface (rear surface) side on the opposite side from the surface which supports the medium M in the platen 4. The configuration of the heater 72 is the same as the configuration of the heater 73.

Furthermore, in the embodiment, an upstream side guiding portion 6 is disposed to be able to support the medium M further on the upstream side in the transport direction of the medium M than the platen 4. The upstream side guiding portion 6 is disposed between the roller pair 21 and the transport roller pair 23 on the transport path of the medium M. Then, also in the same manner in the upstream side guiding portion 6, the heater 71 is disposed on a surface (rear surface) side on the opposite side from the surface which supports the medium M in the upstream side guiding portion 6. Note that, the configuration of the heater 71 is the same as the configuration of the heater 73.

Here, the heater 71 which corresponds to the upstream side guiding portion 6 preheats the medium M further at the transport direction upstream side than the position at which the printing portion 3 is provided. There is a configuration in which drying from a time at which ink is landed is rapidly encouraged by gradually raising the temperature of the medium M from a normal temperature toward a target temperature (temperature in the heater 72). The heater 72 which corresponds to the platen 4 heats the medium M in the discharge region E of the printing portion 3. The heater 72 is configured to cause landed ink to be received on the medium M in a state in which the target temperature is maintained, rapidly encourage drying from a time at which ink is landed, rapidly dry and fix ink to the medium M, prevent bleeding and blurring, and increase image quality. Then, the heater 73 which corresponds to the transport guiding portion 5 raises the temperature of the medium M until the temperature is higher than the raised temperature due to the heater 71 and the heater 72, and rapidly dries a material that is not yet dried out of ink which is landed on the medium M. Thereby, prior to winding at least the roller 22, there is a configuration in which the landed ink is appropriately dried and fixed to the medium M. Note that, temperature settings and the like of the heaters 71, 72, and 73 are able to be appropriately set by combining the medium M, ink, and printing conditions.

The second guiding member 601 has a second bent portion 602, and has a second transport surface 610 on the transport direction downstream side of the medium M. Then, on a second transport surface 610 of the second guiding member 601, a second flat portion 603 is disposed on the transport direction upstream side of the medium M, and the second bent portion 602 is disposed on the transport direction downstream side of the medium M of the second flat portion 603.

The second flat portion 603 has a flat surface, and transports the medium M which is transported from the first flat portion 503 side of the first guiding member 501 to the second bent portion 602 side. The second bent portion 602 has a shape in which a portion of the second transport surface 610 is bent in the transport direction of the medium M. For example, the second bent portion 602 is obtained by forming due to bending a flat plate portion which is a raw material of the second guiding member 601 using a press die. Then, the medium M is transported to the roller 22 side via the second bent portion 602.

In addition, a pair of side surface members 700 are disposed on an end portion which intersects with the transport direction of the medium M of the first guiding member 501 and the second guiding member 601, and the first guiding member 501 and the second guiding member 601 are supported by the side surface member 700. That is, the first guiding member 501 and the second guiding member 601 are supported by a common member. In detail, the first guiding member 501 and the side surface member 700 are fixed by the fastening member 710, and the second guiding member 601 and the side surface member 700 are fixed by the fastening member 711. Thereby, it is possible to stably form the transport path of the medium M.

In addition, as shown in FIG. 5, the first guiding member 501 and the second guiding member 601 are disposed to be separated. In detail, the first guiding member 501 and the second guiding member 601 are disposed in a state of being separated from each other by approximately from 0.1 mm to 1.0 mm (dimension S1) in the transport direction of the medium M. Thereby, interference between the first guiding member 501 and the second guiding member 601 is reduced, and it is possible to more effectively fix and dispose. In addition, the heater 73 is disposed on the first guiding member 501, but heating means such as a heater is not provided on the second guiding member 601. Accordingly, heat from the heater 73 tends not to be transmitted to the second guiding member 601 by configuring the first guiding member 501 and the second guiding member 601 to be separate. For this reason, an operator does not receive thermal influence when the transport guiding portion 5 is displaced to a state of being developed or a state of being folded while contacting with a finger the second guiding member 601 which is the tip end portion of the transport guiding portion 5. In addition, when the medium M which is wound on the roller 22 by the operator is removed, even if the medium M contacts the second guiding member 601 which is the tip end portion of the transport guiding portion 5, the operator does not receive thermal influence.

In addition, as shown in FIG. 5, the height of the second transport surface 610 of the second guiding member 601 is lowered in the dimension direction of the first transport surface 510 of the first guiding member 501. Furthermore, in detail, the height of the front surface of the second flat portion 603 of the second guiding member 601 is approximately 1.0 mm (dimension S2) lower than the height of the front surface of the first flat portion 503 of the first guiding member 501. Furthermore, as appropriate, the height of the front surface of the second flat portion 603 of the second guiding member 601 is set to be lower than a height of the front surface of the first flat portion 503 of the first guiding member 501 such that there is a separation dimension S1 or more between the first guiding member 501 and the second guiding member 601. Thereby, even in a case where a curl (rounding), a crease, or the like is generated at the tip end portion in the transport direction of the transported medium M, it is possible to smoothly transport the medium M which is transported from the first guiding member 501 side to the second guiding member 601 side.

Furthermore, the thicknesses of members of the first guiding member 501 and the second guiding member 601 are different, and the first guiding member 501 is thicker than the second guiding member 601. For example, the first guiding member 501 is configured by a plate material of approximately 2 mm (dimension t1), and the second guiding member 601 is configured by a plate material of approximately 1 mm (dimension t2). Thereby, it is possible to secure rigidity in the first guiding member 501 and improve processability of the second guiding member 601.

According to the embodiment described above, it is possible to obtain the effects indicated below.

The transport guiding portion 5 is configured by two members of the first guiding member 501 and the second guiding member 601. That is, the transport guiding portion 5 is not formed in one member, and the first guiding member 501 and the second guiding member 601 are separately formed. Here, for example, when the transport guiding portion 5 is formed to be one member, since it is necessary to form the first bent portion 502 and the second bent portion 602 in one member, there is a concern that work is difficult and manufacturing yield of the transport guiding portion 5 is reduced. Therefore, by forming the first guiding member 501 and the second guiding member 601 separately, the first bent portion 502 and the second bent portion 602 are easily formed, and it is possible to increase manufacturing (processing) yield of the transport guiding portion 5.

Note that, the invention is not limited to the embodiment described above and it is possible to add various modifications, improvements, or the like to the embodiment described above. Modification examples are described below.

Modification Example 1

In the embodiment, the transport guiding portion 5 is configured by two members of the first guiding member 501 and the second guiding member 601, but is not limited thereto. For example, the transport guiding portion 5 may be configured by three or more members. For example, in the first guiding member 501, the first bent portion 502 and the first transport surface 510 are configured as separate members. That is, the transport guiding portion 5 is configured by three members of the first bent portion 502, the first transport surface 510, and the second guiding member 601. By doing this, workability is improved since it is possible to separately carry out pressing work on respective parts, and furthermore, it is possible to improve manufacturing yield of the transport guiding portion 5.

Modification Example 2

In the embodiment, the heater 73 is disposed on the rear surface side of the transport guiding portion 5, but is not limited to that configuration. For example, the heater which is able to heat the medium M may be configured to be disposed at a position facing the transport surface of the transport guiding portion 5. Thereby, it is possible to heat the medium M on which ink is applied from the surface side using the printing portion 3 with respect to the medium M. In addition, the heater 73 may be provided on both the rear surface side of the transport guiding portion 5 and a position facing the transport surface of the transport guiding portion 5. By doing this, it is possible to more effectively dry ink which is applied to the medium M.

Modification Example 3

A fan device which generates air flow may be disposed at a position facing the transport surface of the transport guiding portion 5. By doing this, it is possible to remove vapor of an ink solvent which is generated when the medium M is dried by the heater 73, and more effectively dry ink.

Modification Example 4

As the printing apparatus 1, a liquid discharge apparatus may be adopted which ejects or discharges another liquid other than ink. For example, it is possible to exchange with various recording apparatuses which are provided with a recording head or the like that discharges a very small amount of liquid droplets. Note that, liquid droplet includes good, granular shape, tear shape, and yarn pulled out in a tail states of liquid which is discharged from the recording apparatus. In addition, the liquid here may be a material that it is possible for the liquid ejecting apparatus to discharge (eject). For example, it is sufficient if the material is in a state of when a substance is in a liquid phase, and the state of the substance is not limited only to being in a fluid state such as a liquid state body having high or low viscosity, a sol, a gel, and other materials such as an inorganic solvent, an organic solvent, a solution, a liquid state resin, and a liquid metal (molten metal), or a liquid in one state of a substance, and a substance where particles of a functional material made from a solid substance such as a pigment or metallic particles are dissolved, dispersed, mixed, or the like in a solvent are included. In addition, as a representative example of the liquid, ink which is described in the embodiment described above is given as an example. Here, ink contains various types of liquid-form compositions such as a typical water-based ink, oil-based ink, gel ink, and hot melt ink. In addition, in addition to plastic films such as vinyl chloride film, the recording medium is intended to encompass a thin thermal expansion functioning paper, textiles such as cloth or fabric, a substrate, a metal plate and the like.

REFERENCE SIGNS LIST

1 Printing apparatus
2 Transport portion
3 Printing portion
4 Platen
5 Transport guiding portion
70 Heat generating portion
71 Heater
80 Support portion
501 First guiding member
502 First bent portion
502*a* Fold
502*b* Flat surface portion
503 First flat portion
510 First transport surface
601 Second guiding member
602 Second bent portion
603 Second flat portion
610 Second transport surface
700 Side surface member The entire disclosure of Japanese Patent Application No. 2015-196536, filed Oct. 2, 2015 is expressly incorporated by reference herein.

The invention claimed is:

1. A printing apparatus comprising:

a printing portion which is able to print on a front surface of medium;

a transport portion which transports the medium; and a transport guiding portion that is downstream of the printing portion in a transport direction, the transport guiding portion forming a portion of a transport surface on which the medium is transported, wherein the transport guiding portion is provided with a first guiding member which has a bent portion and forms the transport surface on a transport direction upstream side of the medium and a second guiding member which has a bent portion and forms the transport surface on a transport direction downstream side of the medium, wherein the first guiding member and the second guiding member are in contact with a back surface of the medium that is not being printed on by the printing portion, wherein the first guiding member and the second guiding member are supported by a common member at an end portion in a direction which intersects with the transport direction, and wherein the first guiding member and the second guiding member are separated, and a distance between the first guiding member and the second guiding member is approximately between 0.1 mm and 1 mm.

2. The printing apparatus according to claim 1, wherein the first guiding member and the second guiding member are separated.

3. The printing apparatus according to claim 1, wherein the second guiding member has a lower height of a normal direction of the transport surface than the first guiding member.

4. The printing apparatus according to claim 1, wherein the first guiding member is a heat generating portion.

5. The printing apparatus according to claim 1, wherein the first guiding member is thicker than the second guiding member.

* * * * *